US011581628B2

(12) United States Patent
Wu et al.

(10) Patent No.: US 11,581,628 B2
(45) Date of Patent: Feb. 14, 2023

(54) ANTENNA STRUCTURE AND ELECTRONIC DEVICE

(71) Applicant: PEGATRON CORPORATION, Taipei (TW)

(72) Inventors: Chien-Yi Wu, Taipei (TW); Shih-Keng Huang, Taipei (TW); Chao-Hsu Wu, Taipei (TW); Yi-Ru Yang, Taipei (TW); Ching-Hsiang Ko, Taipei (TW); Cheng-Hsiung Wu, Taipei (TW); Ming-Huang Chen, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 130 days.

(21) Appl. No.: 17/077,958

(22) Filed: Oct. 22, 2020

(65) Prior Publication Data

US 2021/0151858 A1 May 20, 2021

(30) Foreign Application Priority Data

Nov. 18, 2019 (TW) ..... 108141751

(51) Int. Cl.
*H01Q 1/24* (2006.01)
*H01Q 5/371* (2015.01)
(Continued)

(52) U.S. Cl.
CPC ..... *H01Q 1/243* (2013.01); *H01Q 5/371* (2015.01); *H01Q 9/0457* (2013.01); *H01Q 13/10* (2013.01)

(58) Field of Classification Search
CPC ..... H01Q 1/243; H01Q 9/40; H01Q 9/0457; H01Q 1/2266; H01Q 1/48; H01Q 5/371; H01Q 13/10; H01Q 9/42
See application file for complete search history.

(56) References Cited

U.S. PATENT DOCUMENTS 6,621,455 B2 9/2003 Wang et al.
7,136,024 B2 * 11/2006 Yuanzhu ..... H01Q 13/10 343/700 MS
(Continued)

FOREIGN PATENT DOCUMENTS

CN 103840251 8/2016
TW I356527 1/2012
(Continued)

OTHER PUBLICATIONS

"Search Report of Europe Counterpart Application", dated Apr. 13, 2021, pp. 1-15.
(Continued)

*Primary Examiner* — Graham P Smith
(74) *Attorney, Agent, or Firm* — J.C. Patents

(57) ABSTRACT

An antenna structure includes a first radiator, a second radiator, an antenna ground, and a conductor. The first radiator for resonating at a high frequency band includes a feeding end. The second radiator is connected to the first radiator and resonates at a low frequency band with a part of the first radiator. The antenna ground is located on one side of the first radiator and the second radiator. The conductor is located between the second radiator and the antenna ground in a first direction and connected to the first radiator and the antenna ground. A slit having at least one bending portion is formed among the second radiator, and the conductor and the antenna ground. An electronic device is further provided.

18 Claims, 17 Drawing Sheets

(51) Int. Cl.
*H01Q 9/04* (2006.01)
*H01Q 13/10* (2006.01)

(56) References Cited

U.S. PATENT DOCUMENTS

| | | | | |
|---|---|---|---|---|
| 7,446,708 | B1 * | 11/2008 | Nguyen | H01Q 5/371 343/702 |
| 2005/0104788 | A1 * | 5/2005 | Hung | H01Q 5/371 343/702 |
| 2007/0120753 | A1 * | 5/2007 | Hung | H01Q 5/371 343/702 |
| 2010/0073240 | A1 * | 3/2010 | Cheng | H01Q 9/0421 343/846 |
| 2016/0190699 | A1 * | 6/2016 | Yang | H01Q 9/42 343/700 MS |
| 2019/0123423 | A1 * | 4/2019 | Wu | H01Q 1/243 |

FOREIGN PATENT DOCUMENTS

| | | |
|---|---|---|
| TW | I557991 | 11/2016 |
| TW | I628865 | 7/2018 |
| TW | I652853 | 3/2019 |

OTHER PUBLICATIONS

"Office Action of Taiwan Counterpart Application", dated Dec. 16, 2020, p. 1-p. 11.
"Search Report of Europe Counterpart Application", dated Jul. 22, 2021, p. 1-p. 15.

* cited by examiner

ANTENNA STRUCTURE AND ELECTRONIC DEVICE

CROSS-REFERENCE TO RELATED APPLICATION

This application claims the priority benefit of Taiwan application serial no. 108141751, filed on Nov. 18, 2019. The entirety of the above-mentioned patent application is hereby incorporated by reference herein and made a part of this specification.

BACKGROUND

Technology Field

The disclosure relates to an antenna structure and an electronic device, and in particular to an antenna structure applicable to a device with a thin bezel and an electronic device having the antenna structure.

Description of Related Art

Currently, there are increasing demands for electronic devices with the design of a thin bezel. The design of a thin bezel makes the space for antennas of such electronic devices smaller and smaller and also makes it difficult to design.

SUMMARY

The disclosure provides an antenna structure, which can be applied to a device with a thin bezel.

The disclosure provides an electronic device having the antenna structure.

The antenna structure of the disclosure includes a first radiator, a second radiator, an antenna ground, and a conductor. The first radiator includes a feeding end. The first radiator is configured for resonating at a high frequency band. The second radiator is connected to the first radiator and resonates at a low frequency band with a portion of the first radiator. The antenna ground is located on one side of the first radiator and the second radiator. The conductor is located between the second radiator and the antenna ground in a first direction and connects the first radiator with the antenna ground. A slit having at least one bending portion is formed among the second radiator, the conductor, and the antenna ground.

In an embodiment of the disclosure, the slit has two bending portions and is Z-shaped.

In an embodiment of the disclosure, a length of the slit ranges from 11 mm to 20 mm, and a width of the slit ranges from 0.3 mm to 1.5 mm.

In an embodiment of the disclosure, the conductor has a first part and a second part, the first part is connected to the first radiator, and the second part is connected to the antenna ground. A length of the first part is less than a length of the second part in the first direction, and a length of the second part in a second direction ranges from 7 mm to 11 mm.

In an embodiment of the disclosure, the antenna structure further includes a substrate, a coaxial transmission line, and a conductor grounding layer. The substrate includes a first surface and a second surface opposite to each other. The first radiator, the second radiator, the conductor, and the antenna ground are disposed on the first surface. The coaxial transmission line is located on the second surface and electrically connected to the antenna ground.

In an embodiment of the disclosure, the antenna structure further includes a conductor grounding layer. A portion of the conductor grounding layer is disposed on the first surface and connected to the antenna ground, another portion of the conductor grounding layer extends beyond the substrate and is connected to a system ground, and a length of the conductor grounding layer ranges from 27 mm to 33 mm.

In an embodiment of the disclosure, a total length of the first radiator and the second radiator ranges from 23 mm to 27 mm; and a total width of the first radiator, the second radiator, and the conductor ranges from 3 mm to 5 mm.

In an embodiment of the disclosure, a length of the antenna ground ranges from 27 mm to 33 mm; a width of the antenna ground ranges from 1.5 mm to 4 mm; and a total width of the first radiator, the second radiator, the conductor, and the antenna ground ranges from 6 mm to 8.5 mm.

An electronic device of the disclosure includes housing and the antenna structure.

The housing includes an insulation area; and the antenna structure is disposed in the housing and beside the insulation area.

In an embodiment of the disclosure, the electronic device is a large-sized display device. The electronic device further includes a screen fixed on and exposed from the housing. A length of the screen is greater than 170 cm. The housing includes an insulating back cover and a metal side shell. The insulation area is formed on an opening of the metal side shell, and a total width of the antenna structure ranges from 6 mm to 8.5 mm.

In an embodiment of the disclosure, the electronic device further includes a system ground and a conducting element located in the housing. The conducting element connects the antenna structure and the system ground. A distance between the antenna structure and the system ground ranges from 3.5 mm to 6 mm.

In an embodiment of the disclosure, the electronic device further includes a screen fixed on and exposed from the housing. The housing includes a metal back cover and an insulating side shell. The insulation area is located in the insulating side shell. The metal back cover extends to the insulating side shell and partially covers the insulating side shell. The antenna structure is disposed beside the insulating side shell, and a projection of the metal back cover with respect to the screen covers a projection of the antenna structure with respect to the screen.

In an embodiment of the disclosure, the antenna structure further includes a substrate and a conductor grounding layer. The first radiator, the second radiator, the conductor, and the antenna ground are disposed on the substrate. A portion of the conductor grounding layer is disposed on the substrate and connected to the antenna ground. Another portion of the conductor grounding layer extends beyond the substrate in a bending manner and is connected to the metal back cover. The conductor grounding layer and a portion of the metal back cover together form a resonance chamber.

In an embodiment of the disclosure, a distance between the antenna structure and the insulating side shell ranges from 2 mm to 4 mm.

In an embodiment of the disclosure, a distance between the antenna structure and the metal back cover ranges from 6.5 mm to 8 mm.

In an embodiment of the disclosure, the slit has two bending portions and is Z-shaped, a length of the slit ranges from 11 mm to 20 mm, and a width of the slit ranges from 0.3 mm to 1.5 mm.

In an embodiment of the disclosure, the conductor has a first part and a second part. The first part is connected to the first radiator, and the second part is connected to the antenna ground. A length of the first part is less than a length of the second part in the first direction, and a length of the second part ranges from 7 mm to 11 mm.

In an embodiment of the disclosure, the electronic device further includes a substrate, a coaxial transmission line and a conductor grounding layer. The substrate includes a first surface and a second surface opposite to each other. The first radiator, the second radiator, the conductor, and the antenna ground are disposed on the first surface. The coaxial transmission line is located on the second surface and electrically connected to the antenna ground.

In an embodiment of the disclosure, a total length of the first radiator and the second radiator ranges from 23 mm to 27 mm, and a total width of the first radiator, the second radiator, and the conductor ranges from 3 mm to 5 mm.

In an embodiment of the disclosure, a length of the antenna ground ranges from 27 mm to 33 mm; a width of the antenna ground ranges from 1.5 mm to 4 mm; and a total width of the first radiator, the second radiator, the conductor, and the antenna ground ranges from 6 mm to 8.5 mm.

Based on the above, the antenna structure of the disclosure configures the first radiator for resonating at a high frequency band. The second radiator and a portion of the first radiator are configured for resonating at a low frequency band. The slit is formed between the second radiator and the conductor and between the second radiator and antenna ground. The slit can be configured as a π-type matching circuit, which makes a smaller-sized antenna structure possible, and thereby can be applied to electronic devices with slim border and improve the antenna.

DESCRIPTION OF THE EMBODIMENTS

Figure 1:
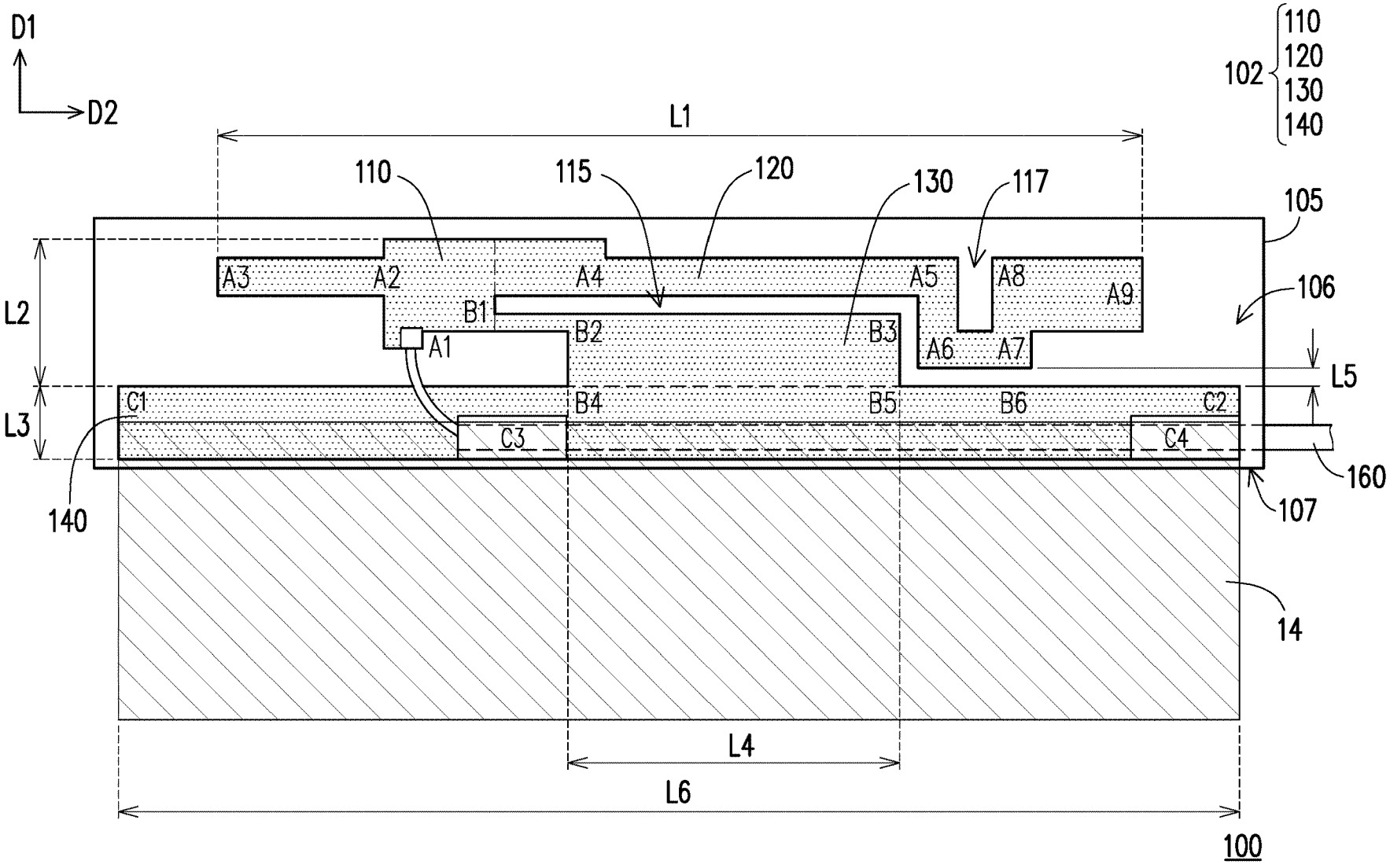
FIG. 1 is a schematic view of an antenna structure according to an embodiment of the disclosure.

FIG. 1 is a schematic view of an antenna structure according to an embodiment of the disclosure. Referring to FIG. 1, an antenna structure 100 of the embodiment includes a first radiator 110, a second radiator 120, an antenna ground 140, and a conductor 130. Specifically, the first radiator 110 is approximately at positions A3, A2, A1, and B1; the second radiator 120 is connected to the first radiator 110 and is approximately at positions B1, A4, A5, A6, A7, A8, and A9; the conductor 130 is approximately at positions B1, B2, B3, B5, and B4; and the antenna ground 140 is approximately at position C1 to position C2.

In the embodiment, the antenna structure 100 at a feeding end (the position A1) of the first radiator 110 extends leftward to the positions A2 and A3 and rightward to the positions A4, A5, A6, A7, A8, and A9 in two respective radiation paths. The two radiation paths and ground paths of the positions B1, B2, B3, B4, and B5 form PIFA antenna architecture and resonate at two antenna bands.

In detail, in the embodiment, the first radiator 110 (the positions A3, A2, A1, and B1) is configured for resonating at a high frequency band. The second radiator 120 (the positions B1, A4, A5, A6, A7, A8, and A9) and a portion of the first radiator 110 (the positions A2 and B1) are configured for resonating at a low frequency band. In the embodiment, the low frequency band is a frequency band for Wi-Fi 2.4 GHz, and the high frequency band is a frequency band for Wi-Fi 5 GHz, but the range of the frequency band at which the antenna structure 100 resonates is not limited thereto.

In addition, the antenna ground 140 is located on one side of the first radiator 110 and the second radiator 120. In the embodiment, a length L6 of the antenna ground 140 ranges from 27 mm to 33 mm and, for example, may be 30 mm. A width of the antenna ground 140 (i.e., a length L3 in a first direction D1) ranges from 1.5 mm to 4 mm and, for example, may be 2 mm.

The conductor 130 is located between the second radiator 120 and the antenna ground 140 along the first direction D1 (i.e., the vertical direction of FIG. 1) and connects the first radiator 110 with the antenna ground 140. As can be seen in FIG. 1, in the embodiment, the conductor 130 has a first part and a second part. The first part (the positions B1 and B2) is connected to the first radiator 110, and the second part (the positions B2, B3, B5, and B4) is connected to the antenna ground 140. In the first direction D1, the length of the first part (the positions B1 and B2) is less than the length of the second part (the positions B2, B3, B5, and B4). Certainly, in other embodiments, the conductor 130 may have only a single length in the first direction D1 or have more lengths, which is not limited thereto.

Generally, a conventional planar PIFA antenna architecture requires a length of 30 mm and a width of 10 mm to achieve better wireless transmission. However, the conventional planar PIFA antenna architecture is difficult to apply to devices with thin bezel due to its large size. In the embodiment, the width of an antenna pattern 102 (a length in the first direction D1), that is, a total width of the first radiator 110, the second radiator 120, the conductor 130, and the antenna ground 140 (i.e., a total length, which is a sum of a length L2 and the length L3, in the first direction D1) ranges from 6 mm to 8.5 mm and, for example, may be 6 mm. Therefore, the antenna pattern 102 has a smaller size and can be applied to devices with thin bezel.

In the embodiment, the reason that the antenna pattern 102 may have a smaller width is that the antenna structure 100 has a slit 115, which has at least one bending portion and is formed among the second radiator 120, the conductor 130, and the antenna ground 140 (i.e., the portion between the positions B1, B2, B3, B5, and B6 and the positions B1, A4, A5, A6, and A7). The slit 115 can be configured as a it-type matching circuit. The slit 115 has two bending portions and is Z-shaped, but the shape of the slit 115 is not limited thereto.

Figure 2:
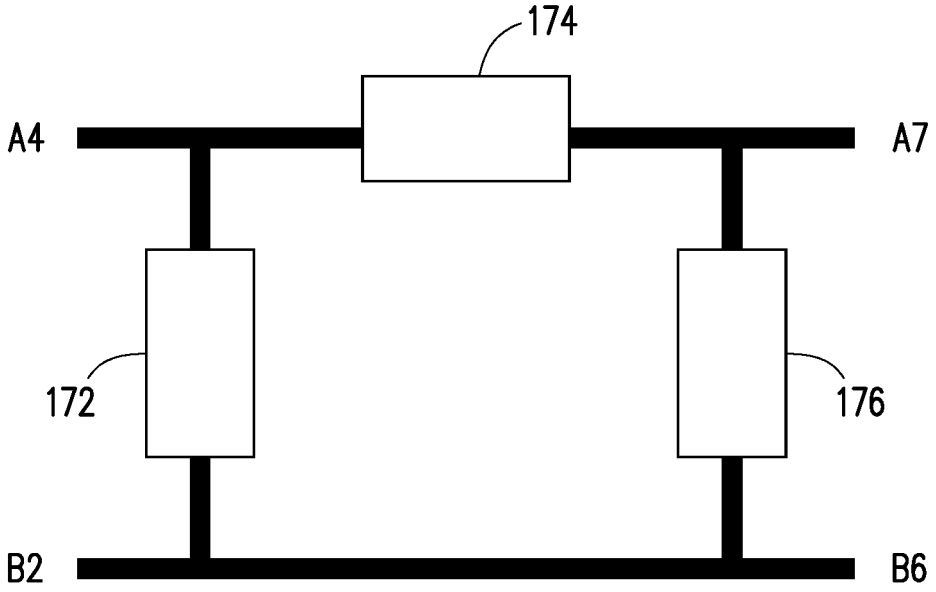
FIG. 2 is a schematic view of an equivalent circuit of a slit of the antenna structure in FIG. 1.

FIG. 2 is a schematic view of an equivalent circuit of a slit of the antenna structure in FIG. 1. Referring to FIGS. 1 and 2 together, in the embodiment, the portion of the slit 115 (see FIG. 1) between the position A4 and the position B2 has the capacitance effect in the circuit, functioning as a capacitor 172 disposed between the position A4 and the position B2. The path of the slit 115 at the positions A4, A5, A6, and A7 (i.e., the path of the Z-shaped slit 115) has the inductance effect in the circuit, functioning as an inductor 174 disposed between the position A4 and the position A7. The portion of the slit 115 between the position A7 and the position B6 has the capacitance effect in the circuit, functioning as a capacitor 176 disposed between the position A7 and the position B6.

In this way, by changing the equivalent circuit of the slit 115 and a width of the second part of the conductor 130, the impedance matching of the high frequency band and the low frequency band can be adjusted, the peak gain can be reduced, and the antenna efficiency can be improved.

Specifically, a total length L1 of the first radiator 110 and the second radiator 120 ranges from 23 mm to 27 mm in the first direction D1 and, for example, 25 mm. A total width of the first radiator 110, the second radiator 120, and the conductor 130 (i.e., the length L2 taken up by the first radiator 110, the second radiator 120, and the conductor 130 in the second direction D2) ranges from 3 mm to 5 mm and, for example, 4 mm. In other words, in the embodiment, an area occupied by the first radiator 110, the second radiator 120, and the conductor 130 is reduced to an area of 25 mm×4 mm.

In the embodiment, a length of the slit 115 ranges from 11 mm to 20 mm, and for example, 17 mm. A width L5 of the slit 115 ranges from 0.3 mm to 1.5 mm, and for example, 0.5 mm. Certainly, the length and the width L5 of the slit 115 are not limited thereto.

Note that, in the embodiment, the designer can use the equivalent circuit of the slit 115 and a length L4 (which ranges from 7 mm to 11 mm and, for example, 9 mm) of the second part (i.e., the portion at the positions B2, B4, B3, and B5) of the conductor 130 to adjust the impedance matching of its dual frequency (Wi-Fi 2.4 GHz and Wi-Fi 5 GHz), reduce the peak gain, and improve the antenna efficiency. In addition, in the embodiment, a portion of the second radiator 120 bends at the positions A5, A6, A7, and A8 and forms a notch 117, whose length of the notch 117 is 2 mm, and whose width is 1 mm. The notch 117 can be configured to adjust the frequency to Wi-Fi 2.4 GHz.

As can be seen in FIG. 1, the antenna structure 100 further includes a substrate 105 and a coaxial transmission line 160. A length, width, and height of the substrate 105 roughly ranges from 27 mm to 33 mm (e.g. 30 mm), 6 mm to 8.5 mm (e.g. 6 mm), and 0.3 mm to 0.5 mm (e.g. 0.4 mm), but the disclosure is not limited thereto. In the embodiment, the substrate 105 is a double-sided circuit board; the substrate 105 includes a first surface 106 and a second surface 107 opposite to each other. The first radiator 110, the second radiator 120, the conductor 130, and the antenna ground 140 are disposed on the first surface 106 while the coaxial transmission line 160 is located on the second surface 107 and is electrically connected to the antenna ground 140.

In the embodiment, since the coaxial transmission line 160 is located on the second surface 107, a portion of the antenna structure 100 at the position A1 goes through a via hole (not shown) of the substrate 105 and is electrically connected to a positive end of the coaxial transmission line 160. The antenna ground 140 of the antenna structure 100 (i.e., the path between the positions C1 and C2) goes through a via hole (not shown) of the substrate 105 and is electrically connected to a negative end of the coaxial transmission line 160 at the ground terminal (i.e., the portion between the position C3 and the position C4). Certainly, in other embodiments, the substrate 105 may be a single sided circuit board, and the first radiator 110, the second radiator 120, the conductor 130, the antenna ground 140, and the coaxial transmission line 160 may be on the same surface.

In addition, the antenna structure 100 further includes a conductor grounding layer 14, a portion of the conductor grounding layer 14 is disposed on the first surface 106 and connected to the antenna ground 140, and another portion of the conductor grounding layer 14 extends beyond the substrate 105 and is connected to a system ground (not shown). The conductor grounding layer 14 is, for example, a copper foil, but the disclosure is not limited thereto. The conductor grounding layer 14 may be welded to a portion of the antenna ground 140 (i.e., the path between the positions C1, B4, B5, B6, and C2), for example, a position at a width of 1 mm, and another portion of the conductor grounding layer 14 is connected to the system ground. In the embodiment, a length of the conductor grounding layer 14 is equal to the length L6 of the antenna ground and ranges from 27 mm to 33 mm and, for example, 30 mm, but the disclosure is not limited thereto.

Figure 3A:
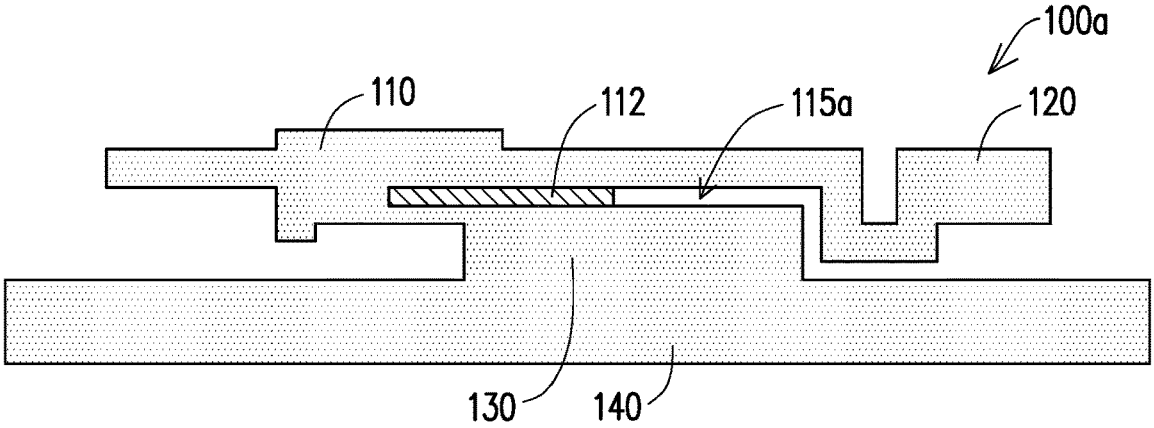
FIGS. 3A to 3C are schematic views of various antenna structures according to different embodiments of the disclosure.
Figure 3B:
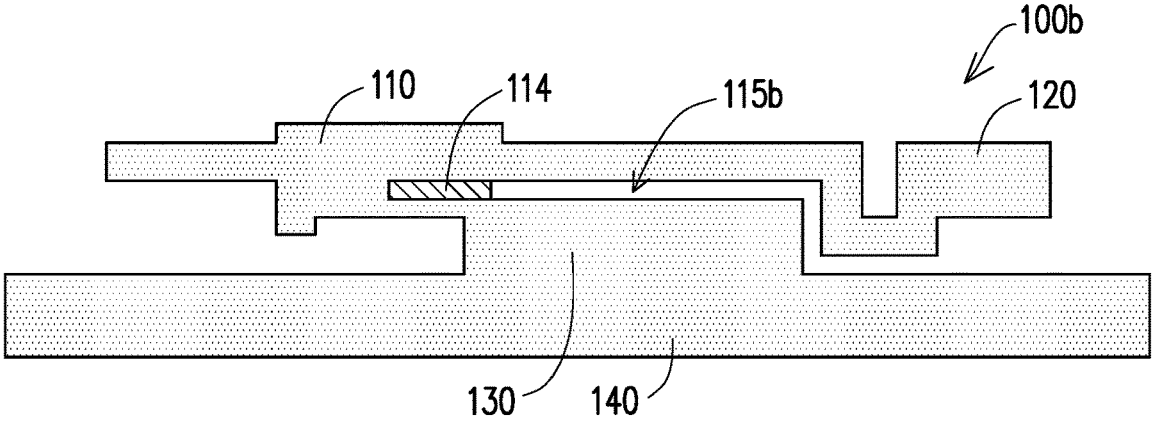
Figure 3C:
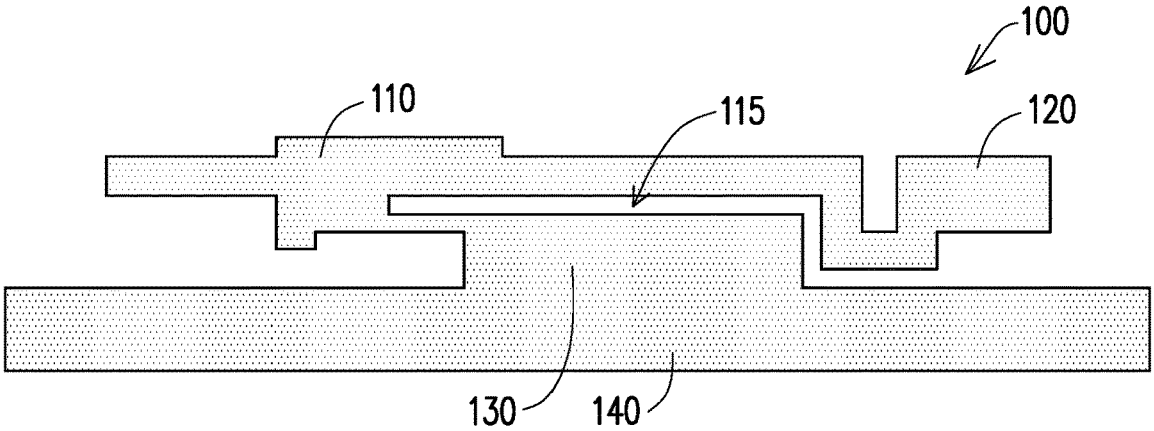

FIGS. 3A to 3C are schematic views of different antenna structures according to different embodiments of the disclosure. Referring to FIG. 3A to FIG. 3C, antenna structures 100*a*, 100*b*, and 100 have respective slits 115*a*, 115*b*, and 115 in different lengths. In detail, the antenna structure 100*a* of FIG. 3A is the antenna structure 100 of FIG. 1, but with a copper foil 112 disposed on the slit 115. A length of the copper foil 112 is 6 mm so that the slit 115*a* has a smaller length, for example, 11 mm. The antenna structure 100*b* of FIG. 3B is the antenna structure 100 of FIG. 1, but a copper foil 114 disposed on the slit 115. A length of the copper foil 114 is 3 mm so that the length of the slit 115*b* can be 14 mm. The antenna structure 100 of FIG. 3C is the same as the antenna structure 100 of FIG. 1, and the length of the slit 115 is 17 mm.

Figure 3D:
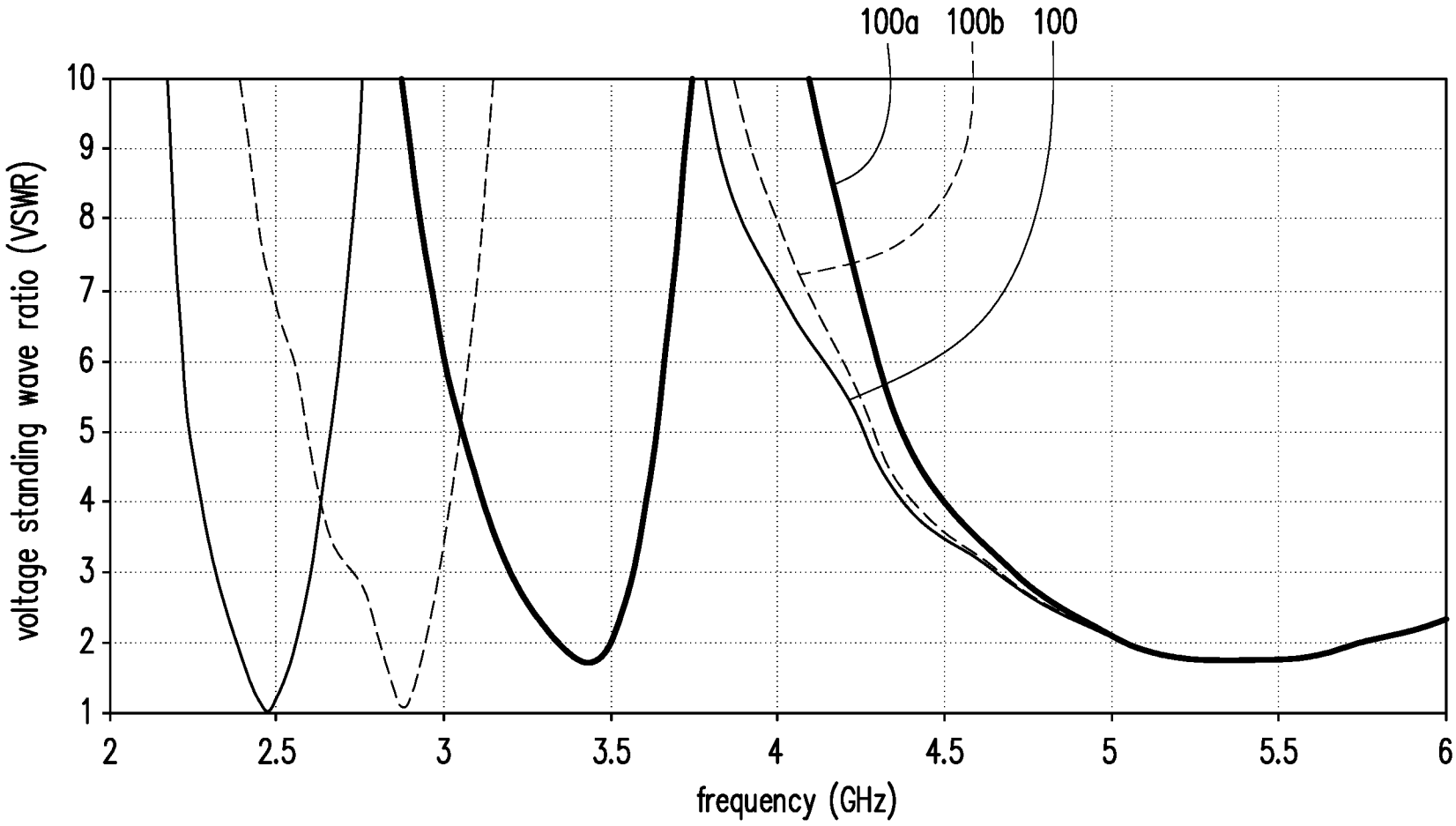
FIG. 3D is a schematic view of the frequency-voltage standing wave ratios of the antenna structure in FIGS. 3A to 3C.

FIG. 3D is a schematic view of the frequency-voltage standing wave ratios of the antenna structure of FIGS. 3A to 3C. Referring to FIG. 3D, the antenna structures 100*a*, 100*b*, and 100 have better performance at a frequency band of Wi-Fi 5G, and the antenna structure 100 of FIG. 3C has better performance at a frequency band of Wi-Fi 2.4G.

Figure 3E:
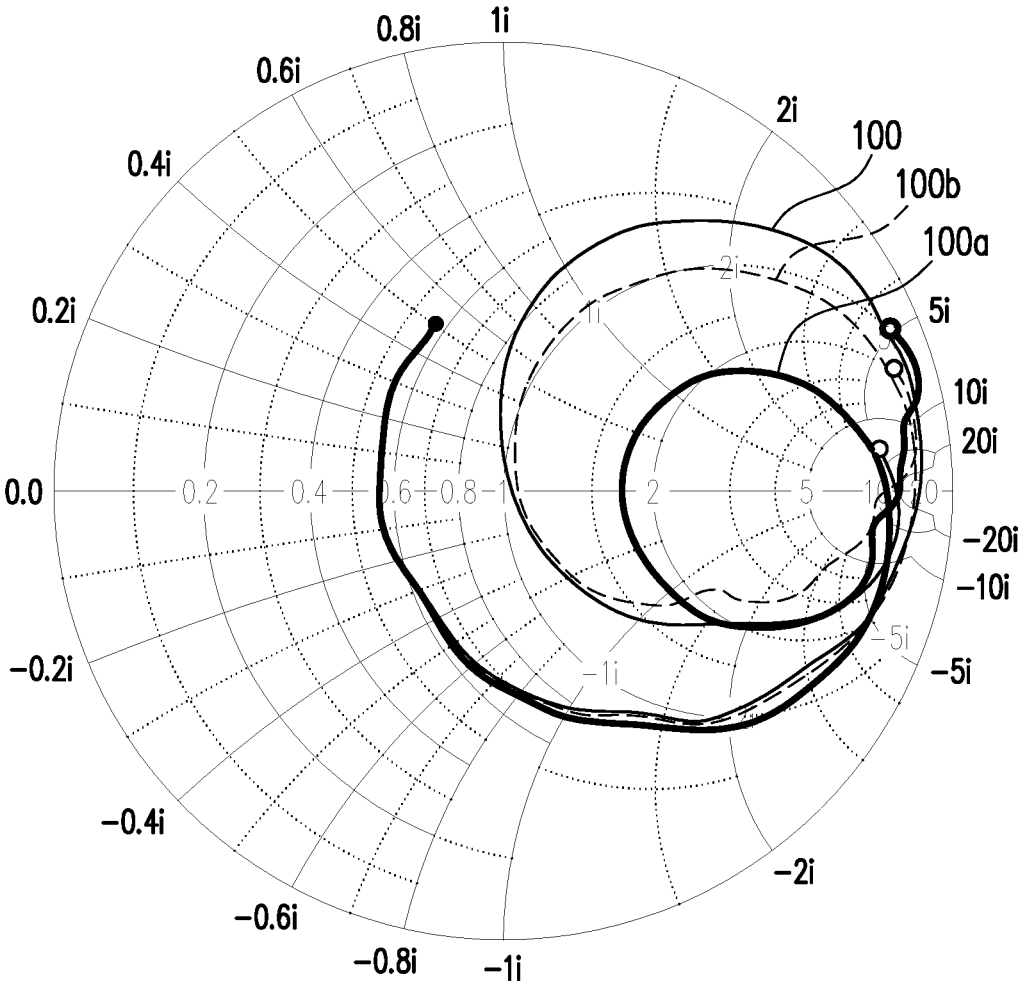
FIG. 3E is a Smith chart of the antenna structures in FIGS. 3A to 3C.

FIG. 3E is a Smith chart of the antenna structures of FIGS. 3A to 3C. As can be seen in FIG. 3E, the Smith chart of the antenna structure 100*a* of FIG. 3A, the antenna structure 100*b* of FIG. 3B, and the antenna structure 100 of FIG. 3C shows a gradually moving-up and enlarging spiral in a clockwise manner, and the antenna structures have a characteristic of inductance in series. The greater the length of the slits 115*a*, 115*b* and 115, the closer the frequency of Wi-Fi 2.4 GHz can be adjusted to the quasi-frequency. In other words, the antenna structure 100 of FIG. 3C can have the best performance.

Figure 4A:
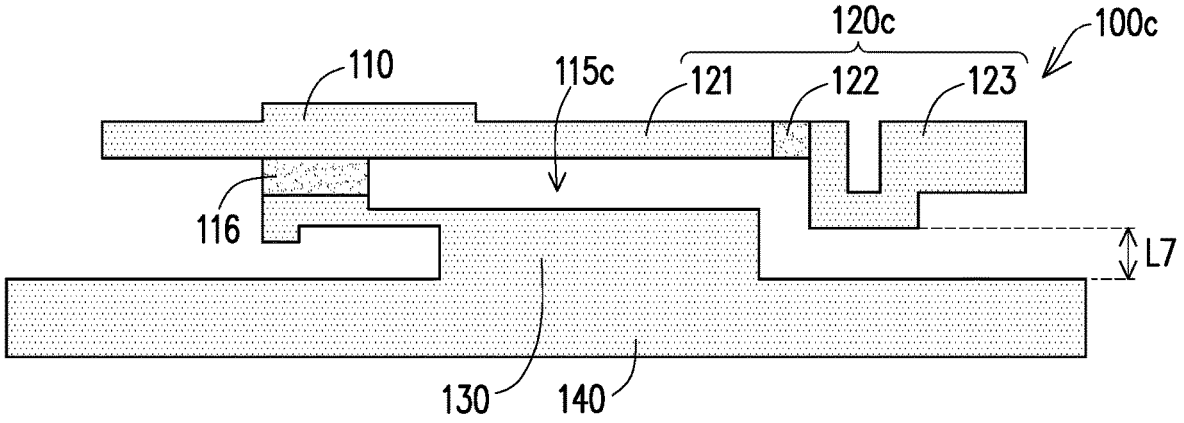
FIGS. 4A to 4C are schematic views of antenna structures according to different embodiments of the disclosure.
Figure 4B:
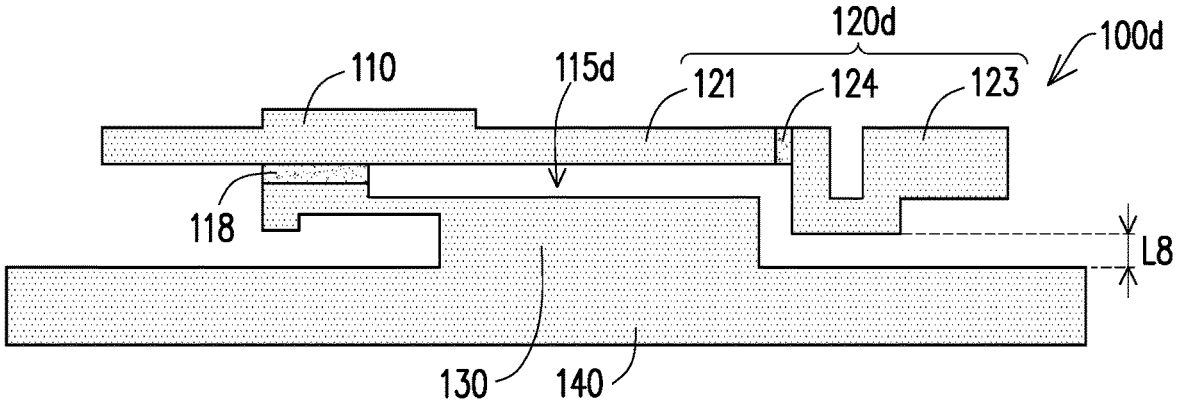
Figure 4C:
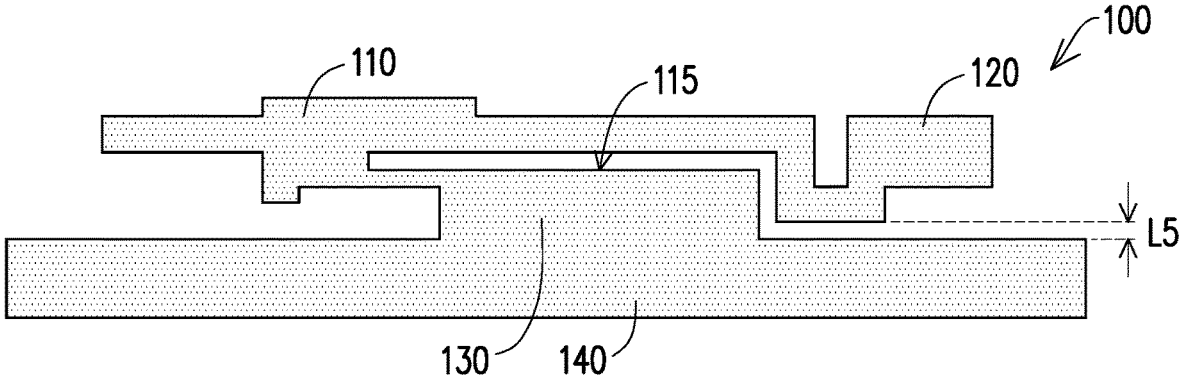

FIGS. 4A to 4C are schematic views of antenna structures according to different embodiments of the disclosure. Referring to FIG. 4A to FIG. 4C, antenna structure 100*c*, 100*d*, and 100 have slits 115*c*, 115*d*, and 115 in respective widths L7, L8, and L5. In detail, in the antenna structure 100*c* of FIG. 4A and the antenna structure 100 of FIG. 1, with a copper foil 116 added to the first radiator 110 and a copper foil 122 added between a portion 121 and a portion 123 of a second radiator 120*c*, the width of the first radiator is increased and the width L7 of the slit 115*c* is increased to 1.5 mm. Similarly, in the antenna structure 100*d* of FIG. 4B and the antenna structure 100 of FIG. 1, with a copper foil 118 added to the first radiator 110 and a copper foil 124 added between the two portions 121 and 123 of a second radiator 120*d*, the width L8 of the slit 115*d* is increased to 1 mm. The antenna structure 100 of FIG. 4C is the same as the antenna structure 100 of FIG. 1, and the width L5 of the slit 115 is 0.5 mm.

Figure 4D:
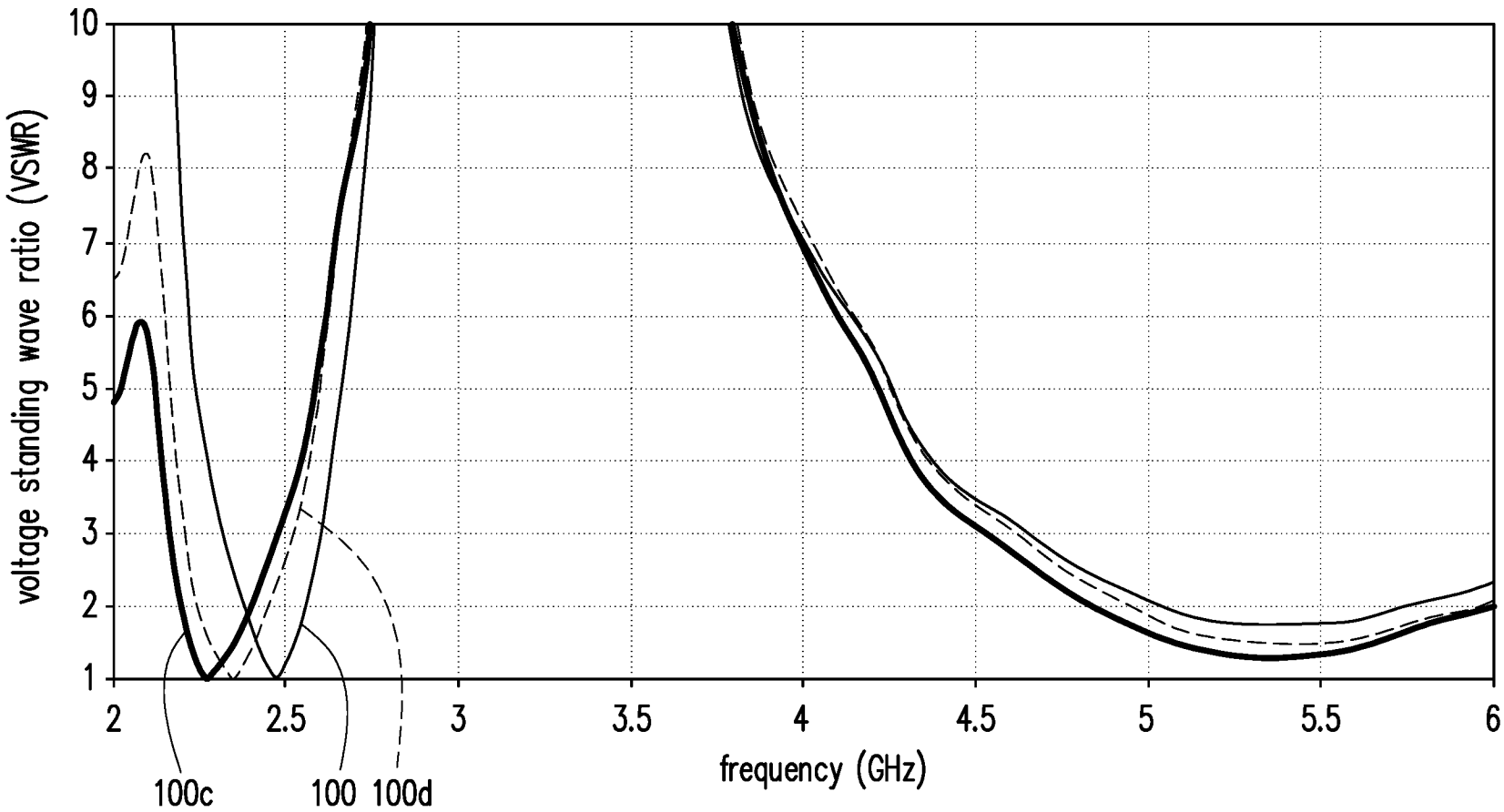
FIG. 4D is a schematic view of the frequency-voltage standing wave ratios of the antenna structures in FIGS. 4A to 4C.

FIG. 4D is a schematic view of the frequency-voltage standing wave ratios of the antenna structures of FIGS. 4A to 4C. Referring to FIG. 4D, the antenna structure 100*c*, 100*d*, 100 have better performance at a frequency band of Wi-Fi 5G, and the antenna structure 100 of FIG. 4C has the best performance at a frequency band of Wi-Fi 2.4G.

Figure 4E:
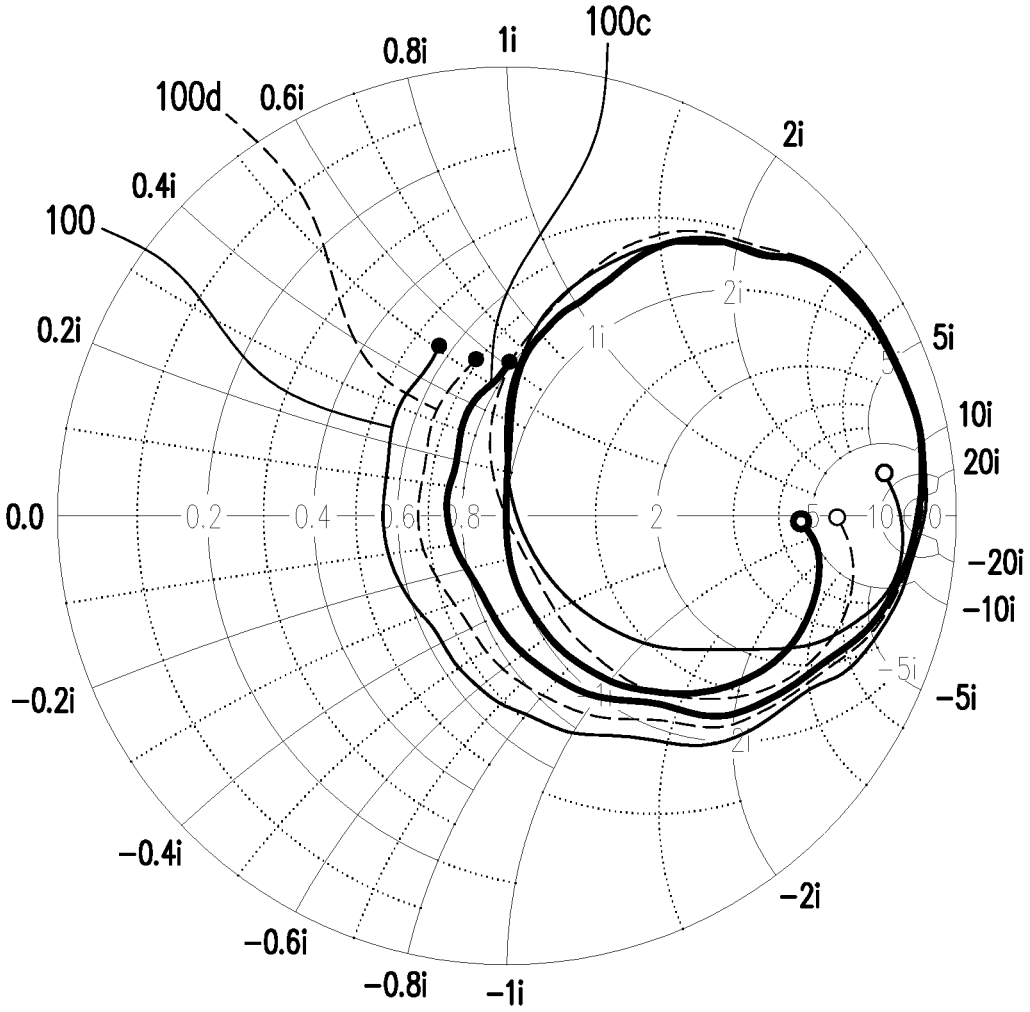
FIG. 4E is a Smith chart of the antenna structures in FIGS. 4A to 4C.

FIG. 4E is a Smith chart of the antenna structures of FIGS. 4A to 4C. As can be seen in FIG. 4E, the Smith chart of the antenna structure 100*c* of FIG. 4A, the antenna structure 100*d* of FIG. 4B, and the antenna structure 100 of FIG. 4C shows a gradually moving-down and enlarging spiral in a clockwise manner, and the antenna structures have a characteristic of capacitance in series. The smaller the width of the slits 115*c*, 115*d* and 115, the closer the frequency of Wi-Fi 2.4 GHz can be adjusted to the quasi-frequency. In other words, the antenna structure 100 of FIG. 4C can have the best performance.

Figure 5A:
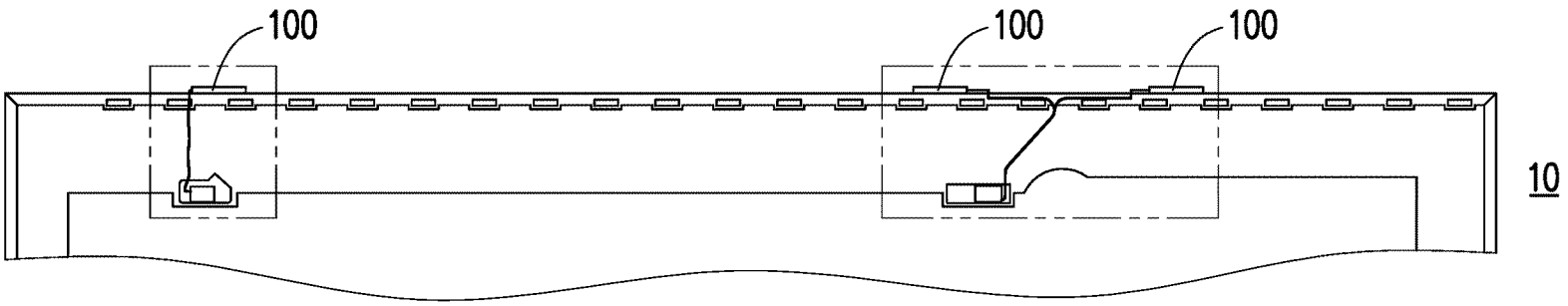
FIG. 5A is a partial schematic view of the interior of an electronic device according to an embodiment of the disclosure.
Figure 5C:
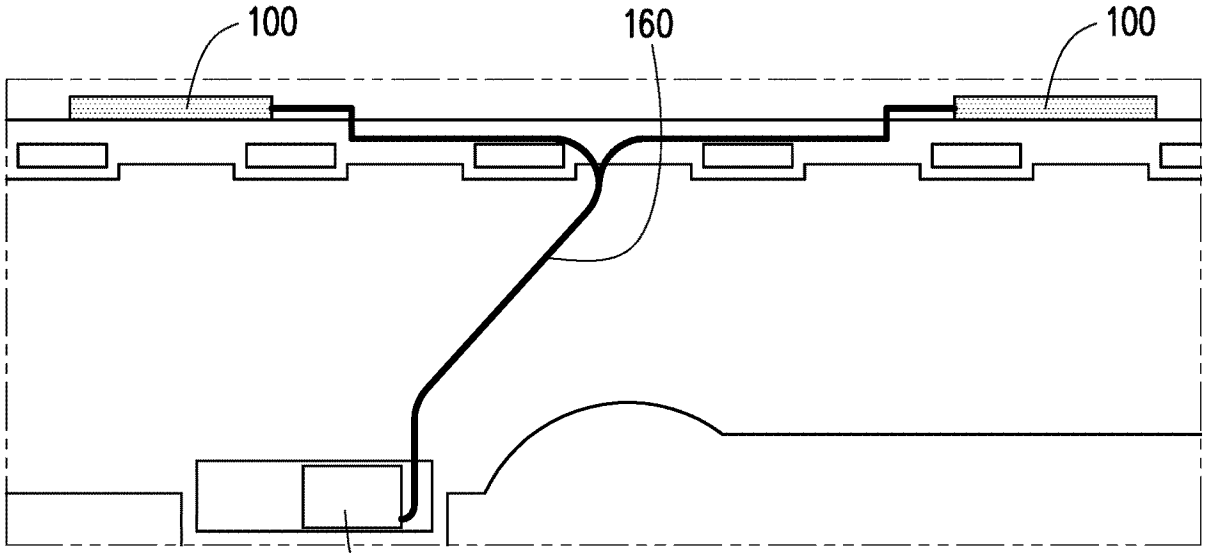
FIGS. 5B and 5C are partial enlarged views of FIG. 5A.
Figure 5B:
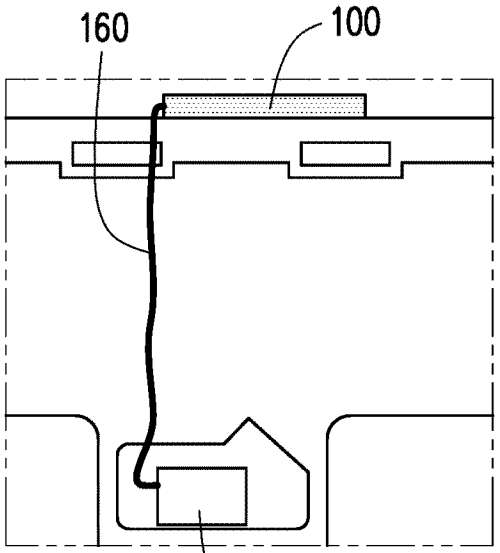
Figure 6:
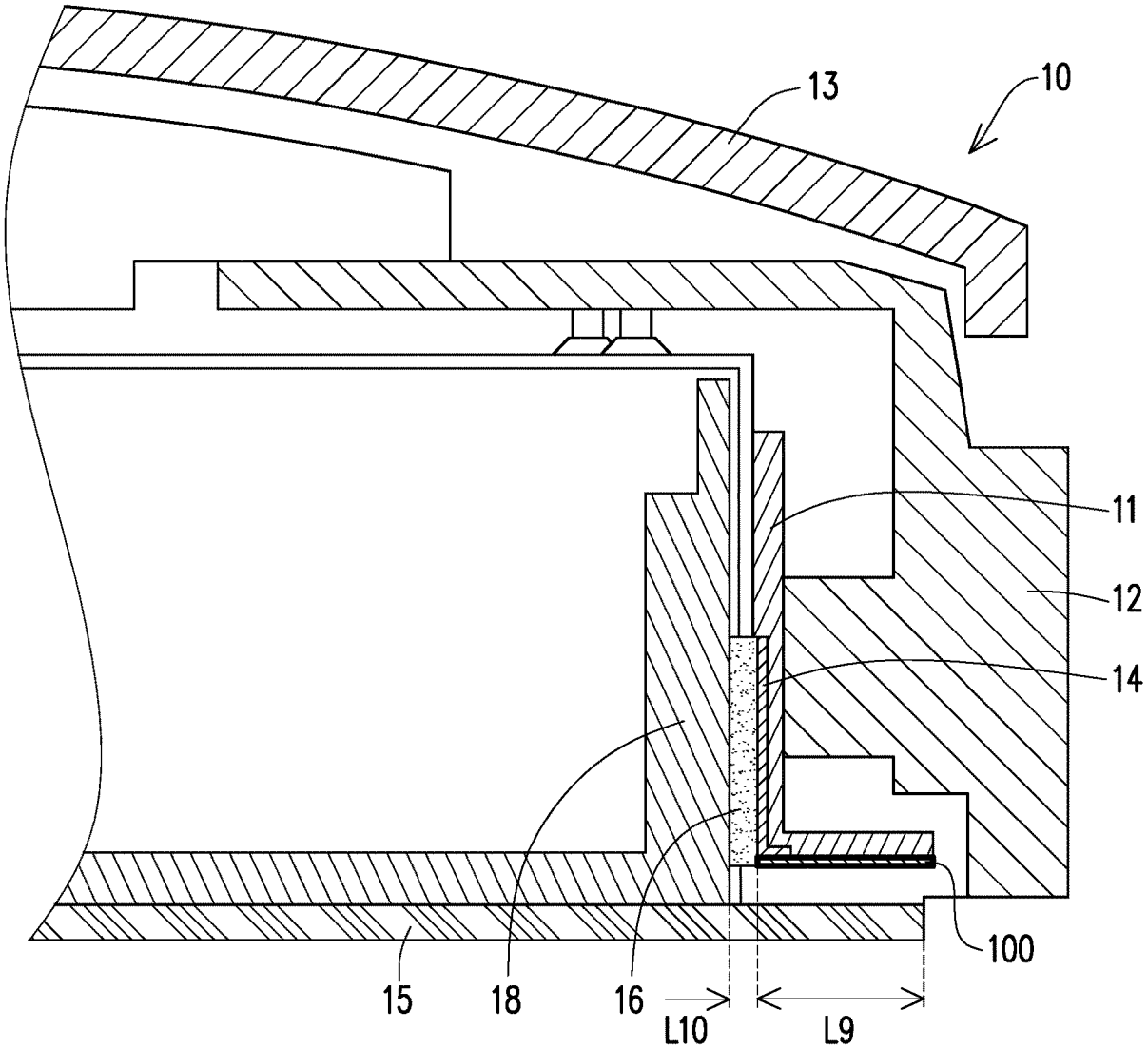
FIG. 6 is a partial cross-sectional view of the electronic device of FIG. 5A.

FIG. 5A is a partial schematic view of the interior of an electronic device according to an embodiment of the disclosure. FIGS. 5B and 5C are partial enlarged views of FIG. 5A. FIG. 6 is a partial cross-sectional view of the electronic device of FIG. 5A. Referring to FIG. 5A to FIG. 6, in the embodiment, the electronic device 10 is exemplified as a large-sized display device, such as a large-sized electronic whiteboard or a television. The electronic device 10 includes a screen 15 (see FIG. 6), and a length of the screen 15 is greater than 170 cm. In an embodiment, the screen 15 is, for example, 86 inches, its length is about 189.5 cm, and its width is about 106.5 cm. Certainly, the sizes of electronic device 10 and screen 15 are not limited thereto.

Generally, a large-sized device is limited by its large system ground, which tends to have the higher directivity of the antenna, and its peak gain tends to be too high, for example, greater than 5 dBi. In the embodiment, the slit 115 is used to reduce the width of the antenna pattern 102 to less than 6 mm. Because the antenna pattern 102 has a smaller width, its peak gain can be reduced. Hence, the requirements of a Bluetooth module card 17 and a Wi-Fi module card 19 are met.

As can be seen in FIGS. 5A to 5C, the electronic device 10 is configured with three antenna structures 100 disposed on an edge of a housing. The antenna structure 100 (serves as a Bluetooth antenna) shown on the left side of FIG. 5A is connected to the Bluetooth module card 17 through the coaxial transmission line 160 (see FIG. 5B). The two antenna structures 100 (serve as Wi-Fi Main antenna and Wi-Fi AUX antenna) shown on the right side of FIG. 5A are connected to the Wi-Fi module card 19 through the coaxial transmission line 160 (see FIG. 5C). In an embodiment, the coaxial transmission line 160 has a length of, for example, 350 mm and is a low loss transmission line with a diameter of 1.13 mm.

As shown in FIG. 6, the housing includes an insulating back cover 13 and a metal side shell (not shown). The metal side shell has an insulation area 12. The insulation area 12 is, for example, a plastic window, which is an opening (not shown) of the metal side shell injection molded with plastic. The screen 15 is shown at the bottom of FIG. 6, and the antenna structure 100 is arranged in the housing, beside the insulation area 12, and above the screen 15. The electronic device 10 further includes a system ground 18 and a conducting element 16 located in the housing. The antenna structure 100 is disposed on an insulation bracket 11, and the antenna structure 100 is connected to the system ground 18 through the conductor grounding layer 14 and the conducting element 16 (e.g., a conductive foam).

In the embodiment, a total width L9 of the antenna structure 100 (the sum of the lengths L2 and L3 in the first direction D1 in FIG. 1) ranges from 6 mm to 8.5 mm, for example, 6 mm. A distance L10 (close to a thickness of the conducting element 16) between the antenna structure 100 and the system ground 18 ranges from 3.5 mm to 6 mm, for example, 4.5 mm.

Figure 7:
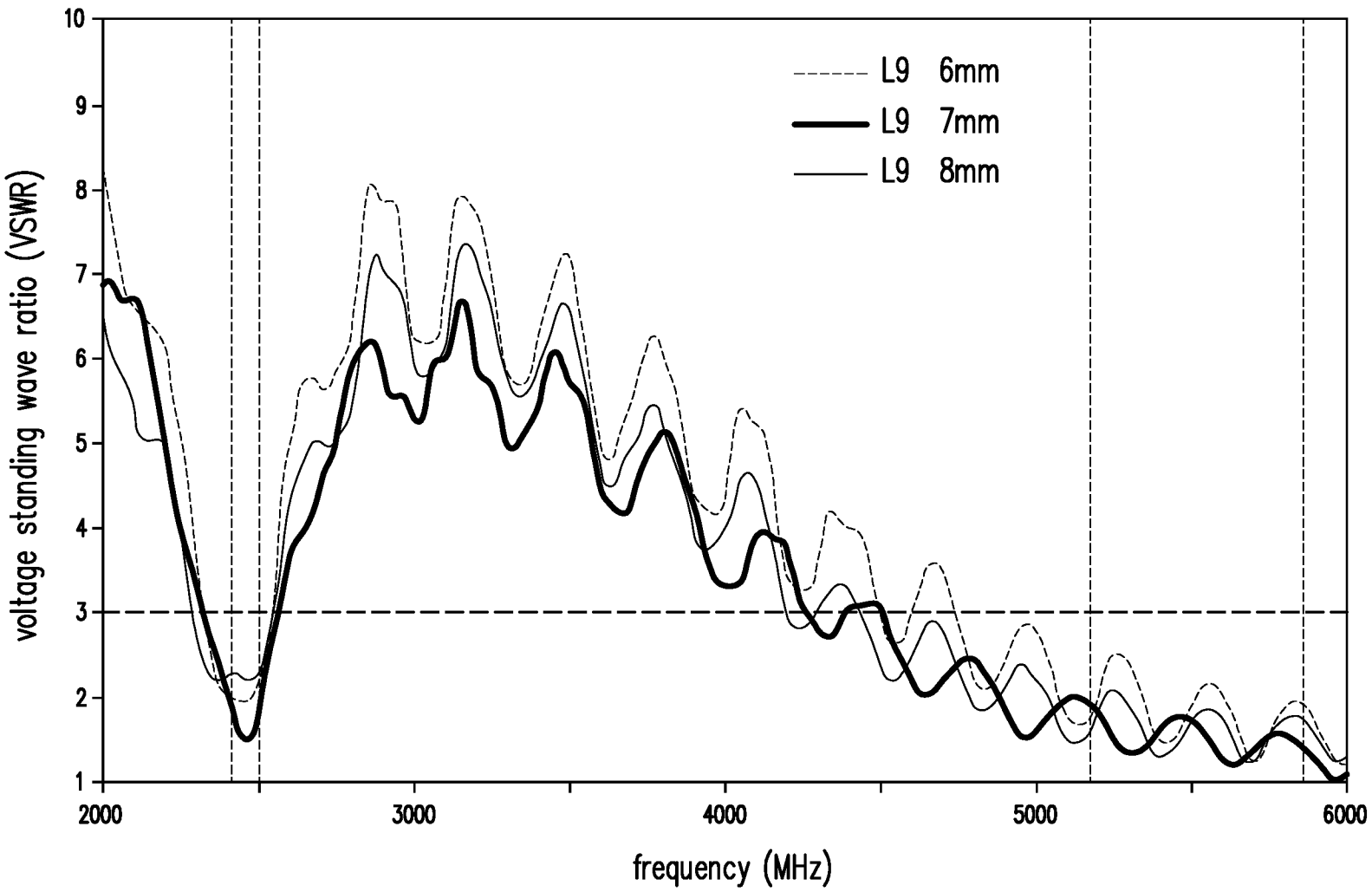
FIG. 7 is a schematic view of the frequency-voltage standing wave ratio of the antenna structure of the electronic device in FIG. 5A with different widths.

FIG. 7 is a schematic view of the frequency-voltage standing wave ratios of the antenna structure of the electronic device of FIG. 5A with different widths. Referring to FIG. 7, the width L9 of the antenna structure 100 is 6 mm, 7 mm, and 8 mm which are indicated by dotted lines, thick lines, and thin lines, respectively. When the width L9 of the antenna structure 100 is 6 mm, 7 mm, and 8 mm, the voltage standing wave ratios (VSWR) of Wi-Fi 2.4G and Wi-Fi 5G can be less than 3. In addition, when the width L9 of the antenna structure 100 is smaller, its impedance matching gradually degrades, and therefore the width L9 of the antenna structure 100 is favorably equal to or greater than 6 mm.

Figure 8:
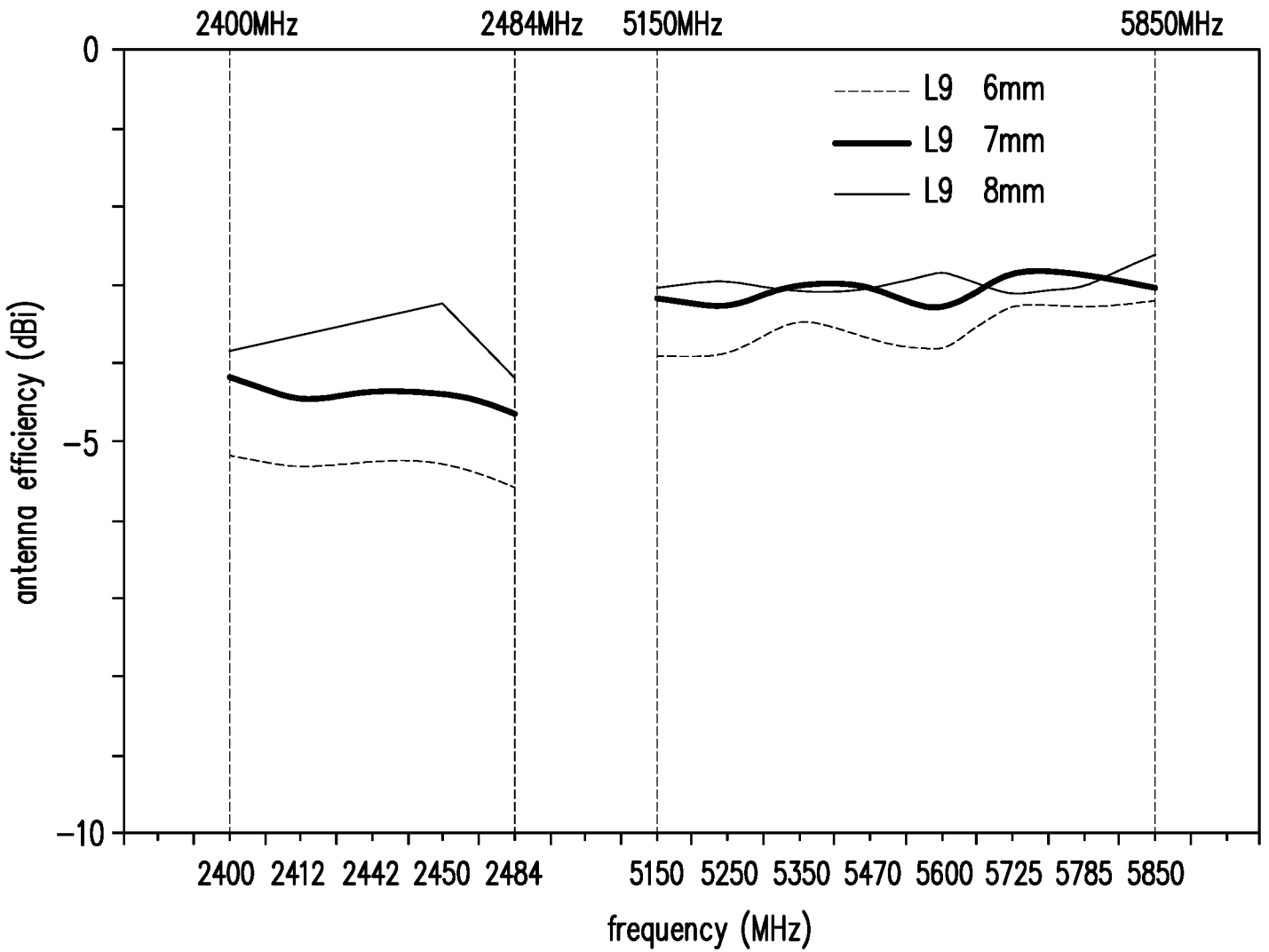
FIG. 8 is a schematic view of the frequency-antenna efficiency of the antenna structure of the electronic device in FIG. 5A with different widths.

FIG. 8 is a schematic view of the frequency-antenna efficiency of the antenna structure of the electronic device of FIG. 5A with different widths. Referring to FIG. 8, when the width L9 of the antenna structure 100 is 6 mm, the antenna efficiency of Wi-Fi 2.4 GHz has reached between −5.2 dBi and −5.5 dBi, and the antenna efficiency of Wi-Fi 5 GHz can be greater than −4 dBi. In addition, when the width L9 of the antenna structure 100 is 7 mm and 8 mm, the antenna efficiency of Wi-Fi 2.4G and Wi-Fi 5G is more favorable.

Figure 9:
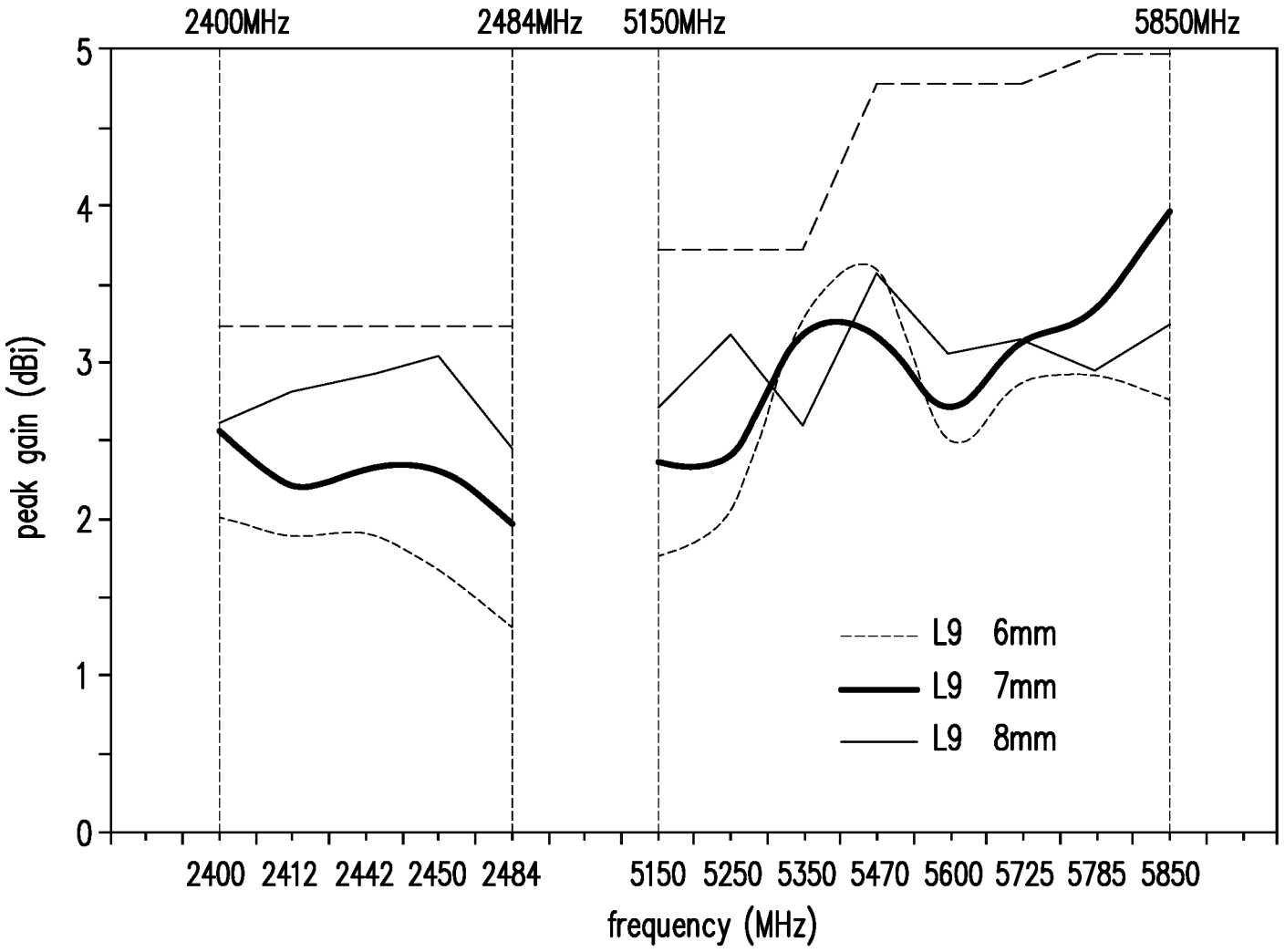
FIG. 9 is a schematic view of the frequency-peak gain of the antenna structure of the electronic device in FIG. 5A with different widths.

FIG. 9 is a schematic view of the frequency-peak gains of the antenna structure of the electronic device of FIG. 5A with different widths. Referring to FIG. 9, when the width L9 of the antenna structure 100 is below 8 mm, its peak gain can meet the requirements of the module cards. In addition, as can be seen in FIG. 8, when the width L9 of the antenna structure 100 is 8 mm, the antenna efficiency of Wi-Fi 2.4G is between −3.2 dBi and −4.2 dBi, and the antenna efficiency of Wi-Fi 5G is between −2.6 dBi and −3.1 dBi. Therefore, when the width L9 of the antenna structure 100 is between 6 mm and 8 mm, both peak gain and antenna efficiency can have better performance.

Figure 10:
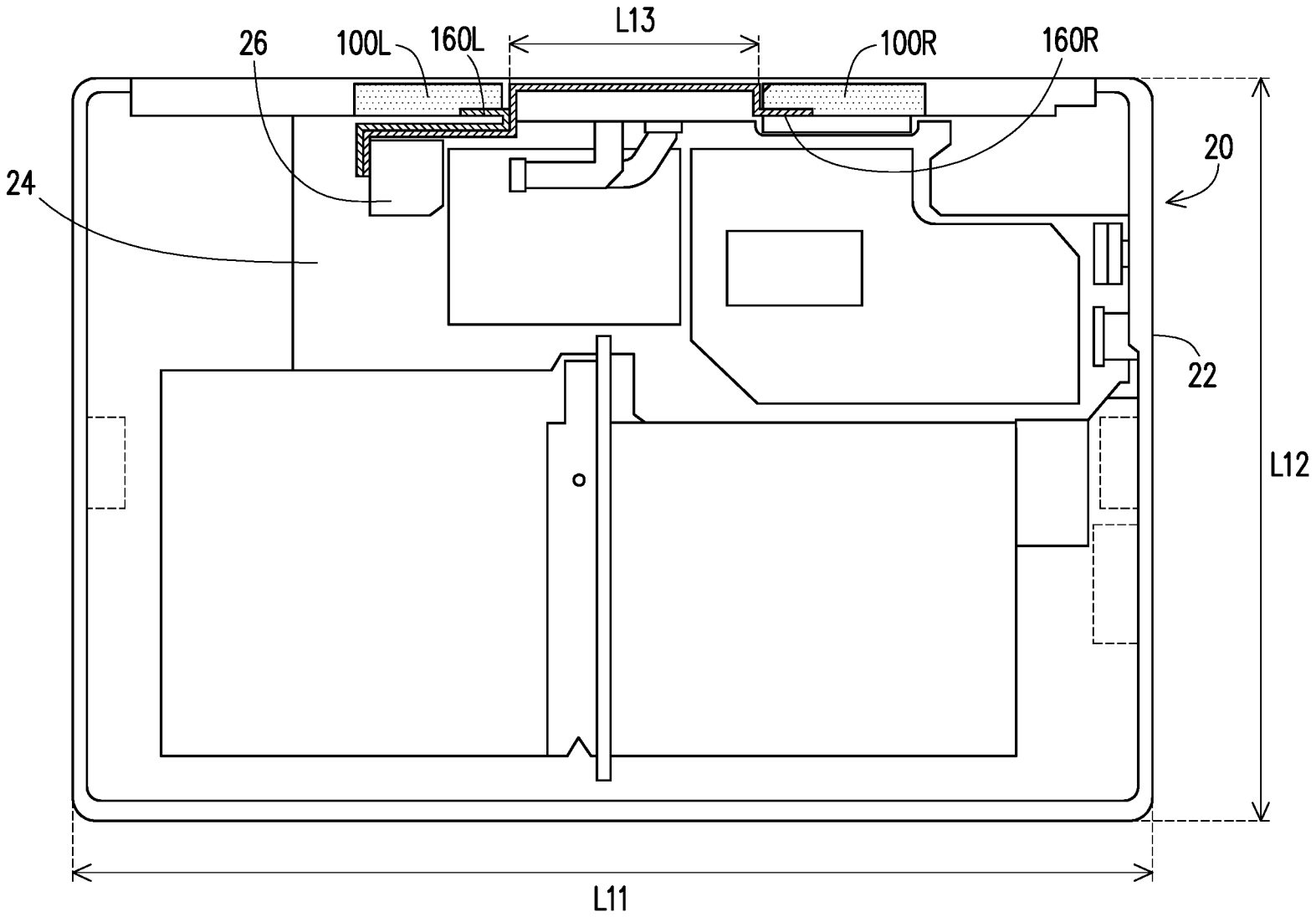
FIG. 10 is a partial schematic view of the interior of an electronic device according to another embodiment of the disclosure.
Figure 11:
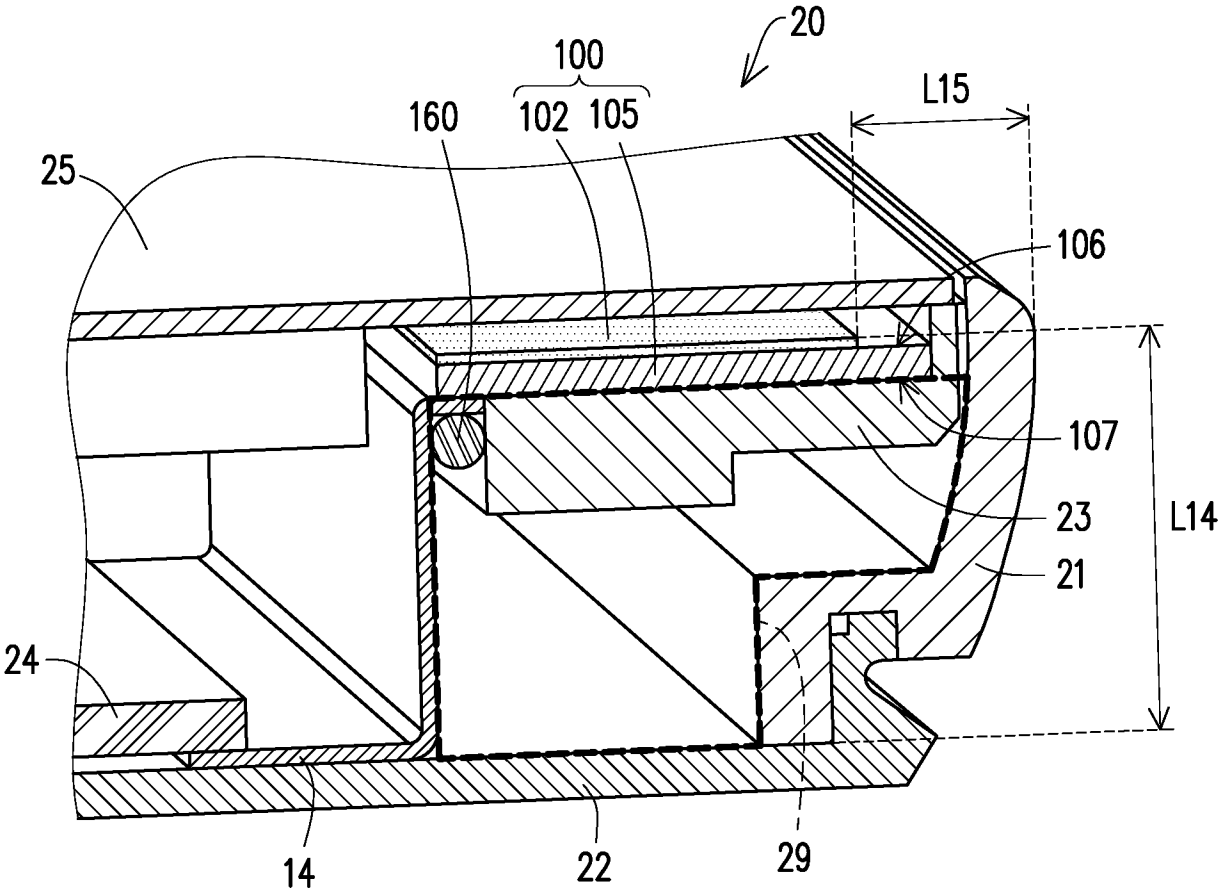
FIG. 11 is a partial cross-sectional view of the electronic device in FIG. 10.
Figure 12:
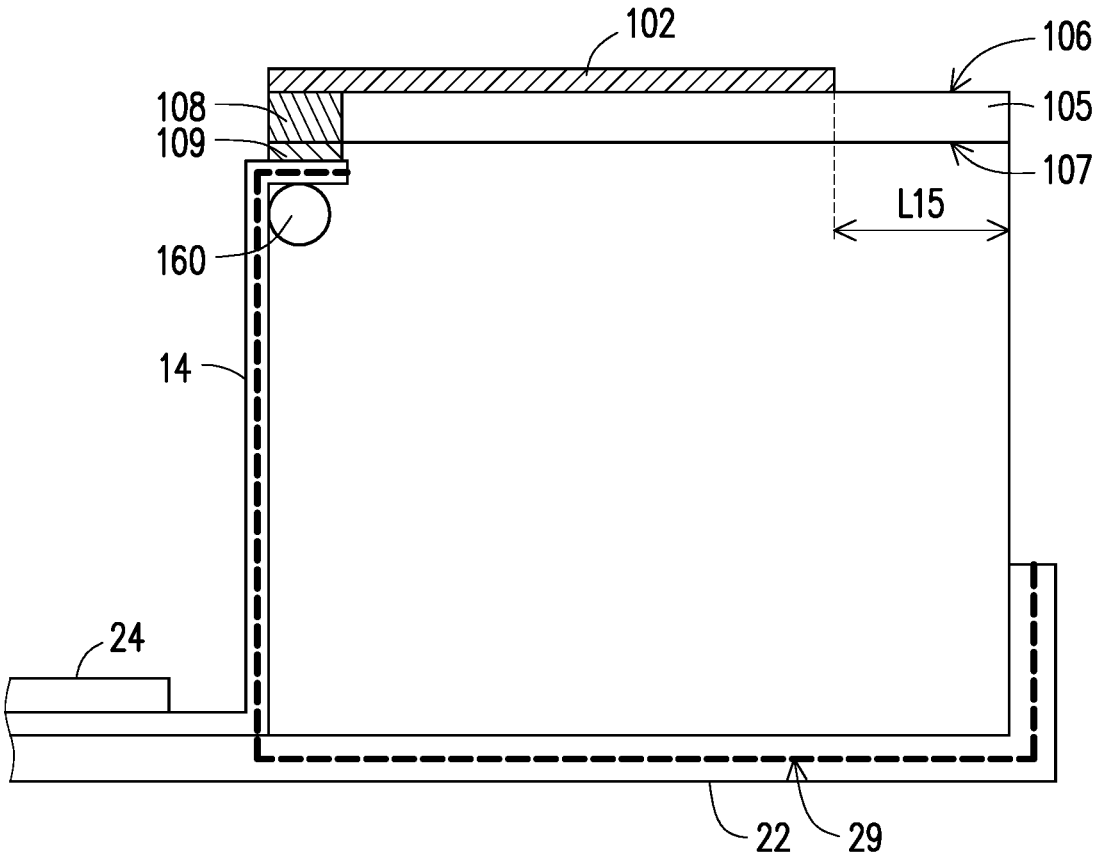
FIG. 12 is a simplified structural view of FIG. 11.

FIG. 10 is a partial schematic view of the interior of an electronic device according to another embodiment of the disclosure. FIG. 11 is a partial cross-sectional view of the electronic device of FIG. 10. FIG. 12 is a simplified structural view of FIG. 11. Referring to FIG. 10 to FIG. 12, in the embodiment, an electronic device 20 is, for example, a tablet device. A length L11 of the whole device is 292 mm, its width L12 is 201 mm, and its height is 8.45 mm.

The electronic device 20 includes two antenna structures 100L and 100R, and a distance L13 between the two antenna structures is 67 mm. The two antenna structures 100L and 100R are connected to a Wi-Fi module card 26 through two coaxial transmission lines 160L and 160R. The antenna structure 100L on the left in FIG. 10 is the Wi-Fi Main antenna, and the length of the coaxial transmission line 160L of the antenna structure 100L is 70 mm. The antenna structure 100R on the right in FIG. 10 is the Wi-Fi AUX antenna, and the length of the coaxial transmission line 160R of the antenna structure 100R is 140 mm. In the embodiment, both coaxial transmission lines 160L and 160R use a low loss transmission line with a diameter of 1.13 mm.

As can be seen in FIG. 11, in the embodiment, a screen 25 of the electronic device 20 is shown at the top in FIG. 11. The housing includes a metal back cover 22 and an insulating side shell 21. An insulation area is located at the insulating side shell 21, and the metal back cover 22 is L-shaped, extends rightward and bends upward to the insulating side shell 21, and partially covers the insulating side shell 21. The antenna structure 100 is disposed on the insulation bracket 23, beside the insulating side shell 21 and close to the screen 25. A projection of the metal back cover 22 onto the screen 25 overlaps with a projection of the antenna structure 100 onto the screen 25.

In the embodiment, the substrate 105 of the antenna structure 100 is a double-sided circuit board, and its length, width, and height are 25 mm, 6 mm, and 0.4 mm, respectively. As can be seen in FIG. 11 and FIG. 12, the antenna pattern is printed on the first surface 106 of the substrate 105, and the conductor grounding layer 14 and the coaxial transmission line 160 are disposed on the second surface 107 of the substrate 105. In FIG. 11, the conductor grounding layer 14 of the antenna structure 100 is Z-shaped and extends from the antenna pattern 102 to the outside of the substrate 105 in a bending manner and is connected to the metal back cover 22 in a bending manner. The antenna structure 100 is connected to the L-shaped metal back cover 22 through the Z-shaped conductor grounding layer 14. The conductor grounding layer 14 and a portion of the metal back cover 22 together form a resonance chamber 29. The conductor grounding layer 14, the portion of the metal back cover 22 and a motherboard 24 of the system integrate into a complete ground surface. The shape of the resonance chamber 29 is close to a shape of J or a shape of U.

In the embodiment, a distance L14 between the first surface 106 of the substrate 105 of the antenna structure 100 and the metal back cover 22 ranges from 6.5 mm to 8 mm, and the distance L14 may be, for example, 6.9 mm. The U-shaped metallic resonance chamber 29 can concentrate an antenna radiation energy of the antenna pattern 102 toward a vertical direction of FIG. 11 and reduce the antenna radiation energy flowing to the direction of the insulating side shell 21 (the right side of FIG. 11). Therefore, the value of edge Specific Absorption Rate (edge SAR) can be effectively reduced. In addition, because the conductor grounding layer 14 is Z-shaped, it may work as a barricade in the vertical direction. The antenna pattern 102 of the antenna structure 100 is separated from the motherboard 24, which can reduce or block the noise source on the motherboard 24, which directly affects the wireless transmission of the antenna structure 100.

In addition, a distance L15 between the antenna pattern 102 of the antenna structure 100 and the insulating side shell 21 ranges from 2 mm to 3 mm, for example, 3 mm. The distance L15 is a preset safety distance when the value of edge SAR is being measured, so the antenna pattern 102 may not be disposed within the distance L15. Compared with a conventional electronic device 20, in order to reduce the electromagnetic wave, it is required to reduce the antenna emission energy to 10 dBm so that the value of electromagnetic wave can comply with regulatory requirements. With the above design, the electronic device 20 of the embodiment does not need to reduce the transmission energy of the antenna, the value of electromagnetic wave can comply with the regulatory requirements, and the electronic device has favorably high antenna efficiency.

The practical test results of edge SAR are shown in Table 1. Compared with the antenna structure of the conventional electronic device with a transmit power of only 10 dBm at Wi-Fi 5 GHz, the antenna structures 100L and 100R of the electronic device 20 of the embodiment can transmit power of 13 dBm at Wi-Fi 5 GHz, which is an increase of 3 dBm.

TABLE 1

| | | Area Scan | |
|---|---|---|---|
| Edge SAR | | The antenna structure 100L on the left side of FIG. 10 (Main antenna) | The antenna structure 100R on the right side of FIG. 10 (Aux antenna) |
| In 802.11b mode | CH1 | — | — |
| Board end transmit | CH6 | 0.93 | — |
| power is 16 dBm. | CH11 | — | 0.82 |
| | CH36 | 1.18 | 1.24 |
| In 802.11a mode | CH64 | 1.37 | 1.27 |
| Board end transmit | CH132 | 1.21 | 1.28 |
| power is 13 dBm. | CH161 | 1.10 | 1.09 |

Figure 13:
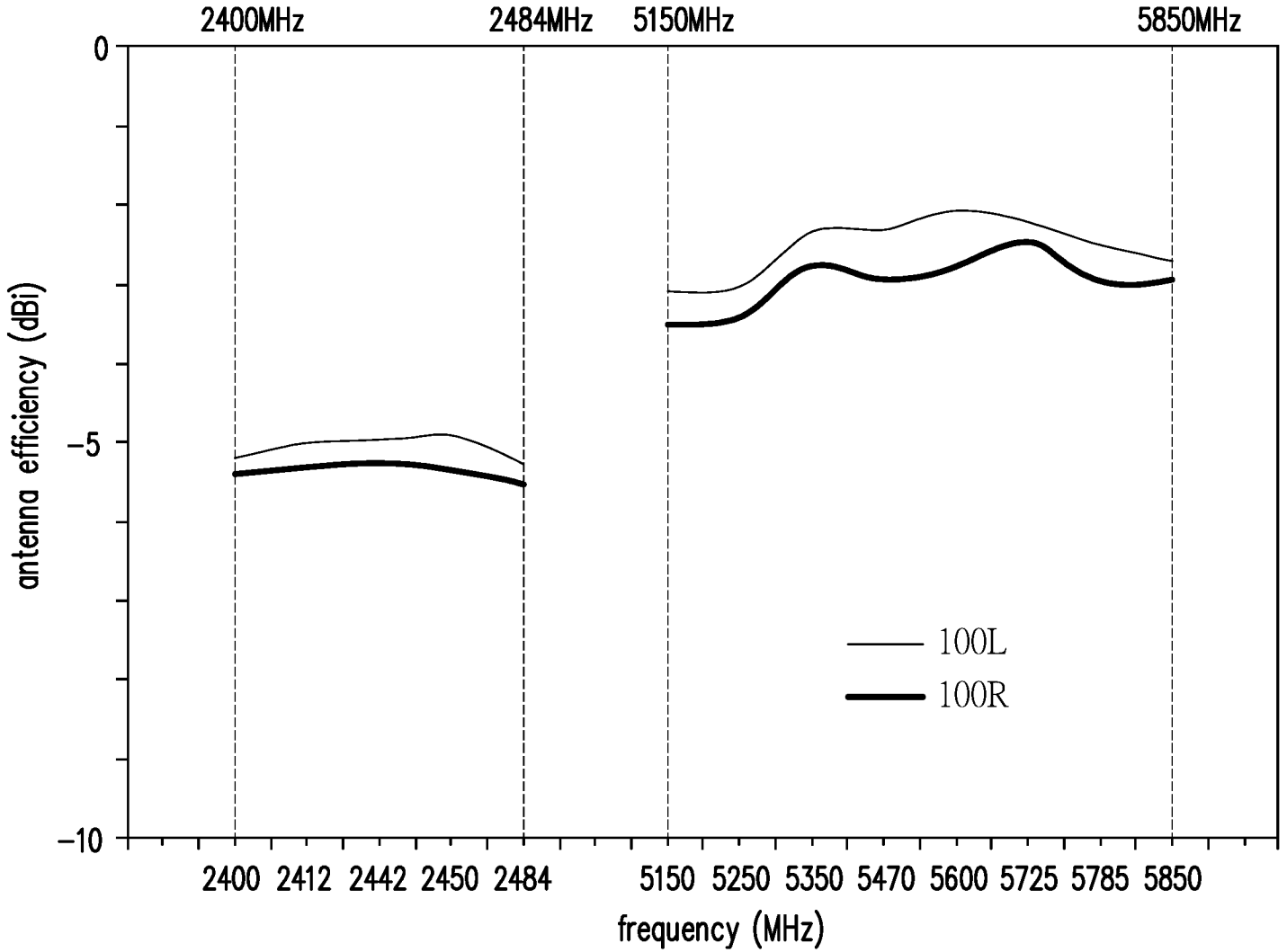
FIG. 13 is a schematic view of the frequency-antenna efficiency of the two antenna structures of the electronic device in FIG. 10.

FIG. 13 is a schematic view of the frequency-antenna efficiency of the two antenna structures of the electronic device of FIG. 10. Referring to FIG. 13, the antenna efficiency of the two antenna structures 100L and 100R at a frequency band of Wi-Fi 2.4G is between −4.9 dBi and −5.5 dBi, and the antenna efficiency at a frequency band of Wi-Fi 5G is between −2.1 dBi and −3.5 dBi. Therefore, the two antenna structures have good antenna efficiency performance.

Based on the above, the antenna structure of the disclosure uses the first radiator for resonating at the high-frequency band and the second radiator and a portion of the first radiator for resonating at the low frequency band. The slit is formed between the second radiator and the conductor and between the second radiator and the antenna ground. The slit can be configured as a π-type matching circuit, which makes a smaller-sized antenna structure possible, and thereby it can be applied to electronic devices with thin bezel and improve the antenna.

What is claimed is:

1. An antenna structure, comprising:

a first radiator for resonating at a high frequency band and having a feeding end;

a second radiator connected to the first radiator and resonating at a low frequency band with a portion of the first radiator;

an antenna ground located on one side of the first radiator and the second radiator; and a conductor located between the second radiator and the antenna ground in a first direction and connecting the first radiator with the antenna ground, wherein a slit having at least one bending portion is formed among the second radiator, the conductor, and the antenna ground, wherein a length of the antenna ground ranges from 27 mm to 33 mm; a width of the antenna ground ranges from 1.5 mm to 4 mm; and a total width of the first radiator, the second radiator, the conductor, and the antenna ground ranges from 6 mm to 8.5 mm.

2. The antenna structure of claim 1, wherein the slit has two bending portions and is Z-shaped.

3. The antenna structure of claim 1, wherein a length of the slit ranges from 11 mm to 20 mm and a width of the slit ranges from 0.3 mm to 1.5 mm.

4. The antenna structure of claim 1, wherein the conductor has a first part and a second part, the first part is connected to the first radiator, the second part is connected to the antenna ground, a length of the first part is less than a length of the second part in the first direction, and a length of the second part in a second direction ranges from 7 mm to 11 mm.

5. The antenna structure of claim 1, further comprising a substrate and a coaxial transmission line, wherein the substrate has a first surface and a second surface opposite to each other; the first radiator, the second radiator, the conductor, and the antenna ground are disposed on the first surface; and the coaxial transmission line is located on the second surface and electrically connected to the antenna ground.

6. The antenna structure of claim 5, further comprising a conductor grounding layer, wherein a portion of the conductor grounding layer is disposed on the first surface and connected to the antenna ground, another portion of the conductor grounding layer extends beyond the substrate and is connected to a system ground, and a length of the conductor grounding layer ranges from 27 mm to 33 mm.

7. The antenna structure of claim 1, wherein a total length of the first radiator and the second radiator ranges from 23 mm to 27 mm; and a total width of the first radiator, the second radiator, and the conductor in the first direction ranges from 3 mm to 5 mm.

8. An electronic device, comprising:

a housing comprising an insulation area; and an antenna structure disposed in the housing and beside the insulation area and comprising:

a first radiator for resonating at a high frequency band and having a feeding end;

a second radiator connected to the first radiator and resonating at a low frequency band with a portion of the first radiator;

an antenna ground located on one side of the first radiator and the second radiator; and a conductor located between the first radiator and the antenna ground and the second radiator and the antenna ground in a first direction and connecting the first radiator with the antenna ground, wherein a slit is formed between the second radiator and the conductor, and between the second radiator and the antenna ground, wherein a length of the antenna ground ranges from 27 mm to 33 mm, a width of the antenna ground ranges from 1.5 mm to 4 mm, and a total length of the first radiator, the second radiator, the conductor, and the antenna ground ranges from 6 mm to 8.5 mm.

9. The electronic device of claim 8, wherein the electronic device is a large-sized display device, the electronic device further comprises a screen fixed on and exposed from the housing, a length of the screen is greater than 170 cm, the housing comprises an insulating back cover and a metal side shell, the insulation area is formed on an opening of the metal side shell, and a total width of the antenna structure ranges from 6 mm to 8.5 mm.

10. The electronic device of claim 9, further comprising a system ground and a conducting element located in the housing, the conducting element connecting the antenna structure and the system ground, a distance between the antenna structure and the system ground ranges from 3.5 mm to 6 mm.

11. The electronic device of claim 8, wherein the electronic device further comprises a screen fixed on and exposed from the housing, the housing comprises a metal back cover and an insulating side shell, the insulation area is located at the insulating side shell, the metal back cover extends to the insulating side shell and partially covers the insulating side shell, the antenna structure is disposed beside the insulating side shell, and a projection of the metal back cover onto the screen covers a projection of the antenna structure onto the screen.

12. The electronic device of claim 11, wherein the antenna structure further comprises a substrate and a conductor grounding layer; the first radiator, the second radiator, the conductor, and the antenna ground are disposed on the substrate; a portion of the conductor grounding layer is disposed on the substrate and connected to the antenna ground; another portion of the conductor grounding layer extends beyond the substrate in a bending manner and is connected to the metal back cover; and the conductor grounding layer and a portion of the metal back cover together form a resonance chamber.

13. The electronic device of claim 11, wherein a distance between the antenna structure and the insulating side shell ranges from 2 mm to 3 mm.

14. The electronic device of claim 11, wherein a distance between the antenna structure and the metal back cover ranges from 6.5 mm to 8 mm.

15. The electronic device of claim 8, wherein the slit has two bending portions and is Z-shaped, a length of the slit ranges from 11 mm to 20 mm, and a width of the slit ranges from 0.3 mm to 1.5 mm.

16. The electronic device of claim 8, wherein the conductor has a first part and a second part, the first part is connected to the first radiator, the second part is connected to the antenna ground, a length of the first part is less than a length of the second part in the first direction, and a length of the second part in a second direction ranges from 7 mm to 11 mm.

17. The electronic device of claim 8, further comprising a substrate and a coaxial transmission line, wherein the substrate comprises a first surface and a second surface opposite to each other; the first radiator, the second radiator, the conductor, and the antenna ground are disposed on the first surface; and the coaxial transmission line is located on the second surface and electrically connected to the antenna ground.

18. The electronic device of claim 8, wherein a total length of the first radiator and the second radiator ranges from 23 mm to 27 mm, and a total width of the first radiator, the second radiator, and the conductor ranges from 3 mm to 5 mm.

* * * * *